US006829788B1

(12) United States Patent
Allen

(10) Patent No.: US 6,829,788 B1
(45) Date of Patent: Dec. 14, 2004

(54) TOILET TRAINING ASSEMBLY

(76) Inventor: Patricia Allen, 1020 Davis Ave., Pittsburgh, PA (US) 15212

( * ) Notice: Subject to any disclaimer, the term of this patent is extended or adjusted under 35 U.S.C. 154(b) by 0 days.

(21) Appl. No.: 10/656,969

(22) Filed: Sep. 8, 2003

(51) Int. Cl.[7] ..... A47K 11/06
(52) U.S. Cl. ..... 4/483; 4/902
(58) Field of Search ..... 4/476, 479, 483, 4/902

(56) References Cited

U.S. PATENT DOCUMENTS 4,883,749 A 11/1989 Roberts et al.
D343,891 S 2/1994 Kessler
5,685,029 A 11/1997 Gee
5,926,864 A 7/1999 Lynch
5,978,976 A 11/1999 Chai
6,038,711 A 3/2000 Clarke
6,698,036 B2 * 3/2004 Armbruster et al. ..... 4/483

* cited by examiner

*Primary Examiner*—Charles E. Phillips

(57) ABSTRACT

A toilet training assembly includes a stool comprising a panel and a plurality of legs that are attached to and extend downwardly from the panel. The panel has a centrally disposed aperture therein. A receptacle is removably mountable in the aperture. A back member is attached to a back edge of the stool. A pair of arms is attached to and extends forward from the back member. A motion detector is mounted in the peripheral edge of the aperture and is directed downwardly such that the motion detector detects material entering the receptacle. A processor is electrically coupled to the motion detector. A dispenser assembly for selectively dispensing candy is positioned in a first arm of the pair of arms. The assembly is operationally coupled to the processor so that the dispenser assembly is turned on when the motion detector detects motion.

9 Claims, 5 Drawing Sheets

TOILET TRAINING ASSEMBLY

BACKGROUND OF THE INVENTION

1. Field of the Invention

The present invention relates to toilet training devices and more particularly pertains to a new toilet training device that rewards a child when the child uses the training toilet.

2. Description of the Prior Art

The use of toilet training devices is known in the prior art. U.S. Pat. No. 6,038,711 describes a toilet training device that resembles a child-friendly character. Another type of toilet training device is U.S. Pat. No. 4,883,749 that utilizes an infrared sensor for determining when excrement has entered a training toilet for the purpose of providing audible and visual reward for a child. Also, U.S. Pat. No. 5,978,976 describes a device that includes sensors for determining when a child has used the toilet. Once that determination has been made, the device plays a musical melody while audibly signaling to the parents that the child is using the toilet.

While these devices fulfill their respective, particular objectives and requirements, the need remains for a device that rewards children in a manner that will ensure that a child will continue to use and will be eager to use a training toilet.

SUMMARY OF THE INVENTION

The present invention meets the needs presented above by providing candy as a reward to the child. Unlike melodies or other rewards, treats provide a greater incentive for a child to utilize the training toilet.

To this end, the present invention generally comprises a stool comprising a panel and a plurality of legs that are attached to and extend downwardly from the panel. The panel has a front edge, a back edge, a first side edge and a second side edge. The panel has a centrally disposed aperture therein. A receptacle is removably mountable in the aperture. A back member is attached to and extends upwardly from the back edge of the stool. A pair of arms is attached to and extends forward from the back member. The arms are spaced from each other and spaced from the panel. A motion detector is mounted in the peripheral edge of the aperture and is directed downwardly such that the motion detector detects material entering the receptacle. A processor is electrically coupled to the motion detector. A dispenser assembly for selectively dispensing candy is positioned in a first arm of the pair of arms. The assembly is operationally coupled to the processor so that the dispenser assembly is turned on when the motion detector detects motion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
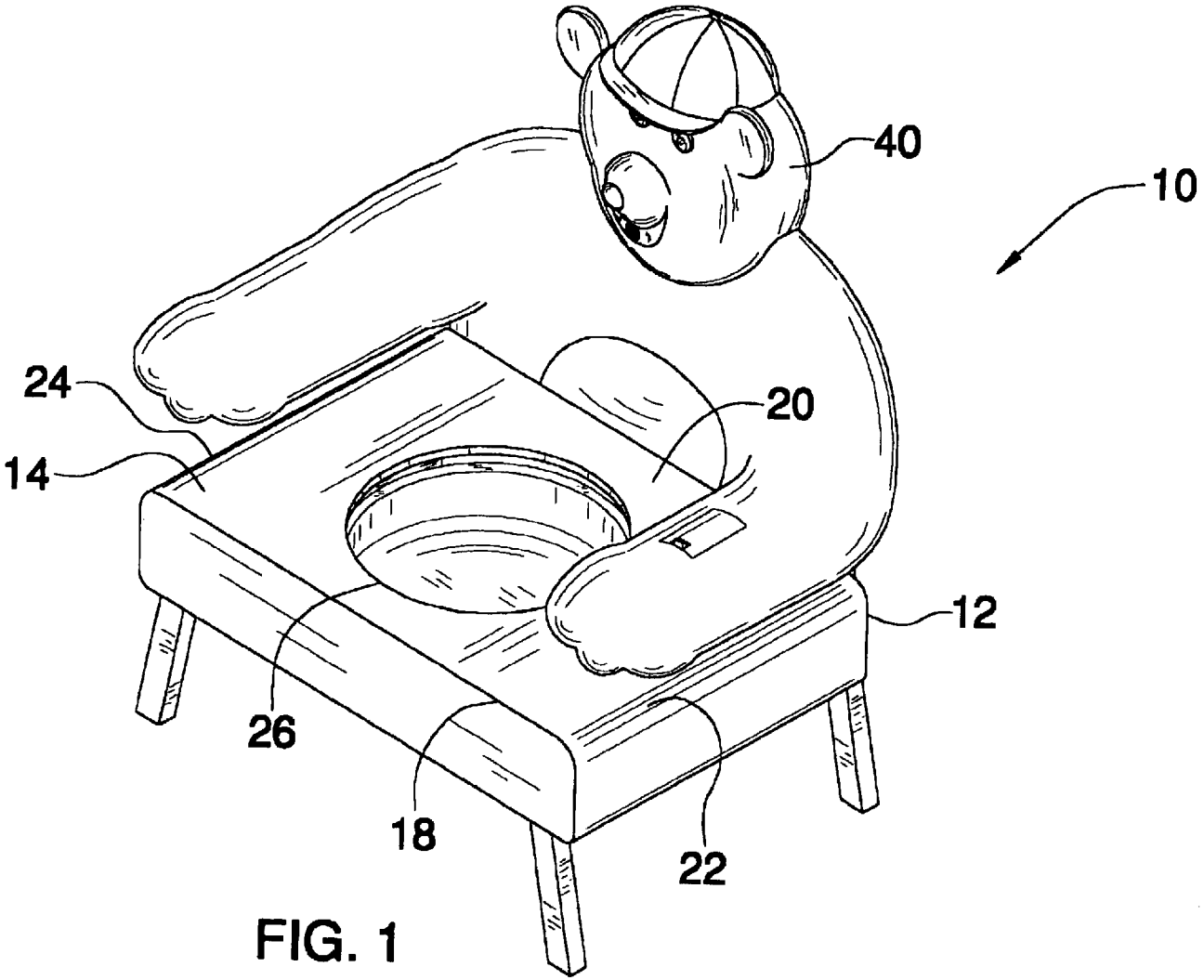
FIG. 1 is a schematic perspective view of a toilet training assembly according to the present invention.

With reference now to the drawings, and in particular to FIGS. 1 through 5 thereof, a new toilet training device embodying the principles and concepts of the present invention and generally designated by the reference numeral 10 will be described.

Figure 2:
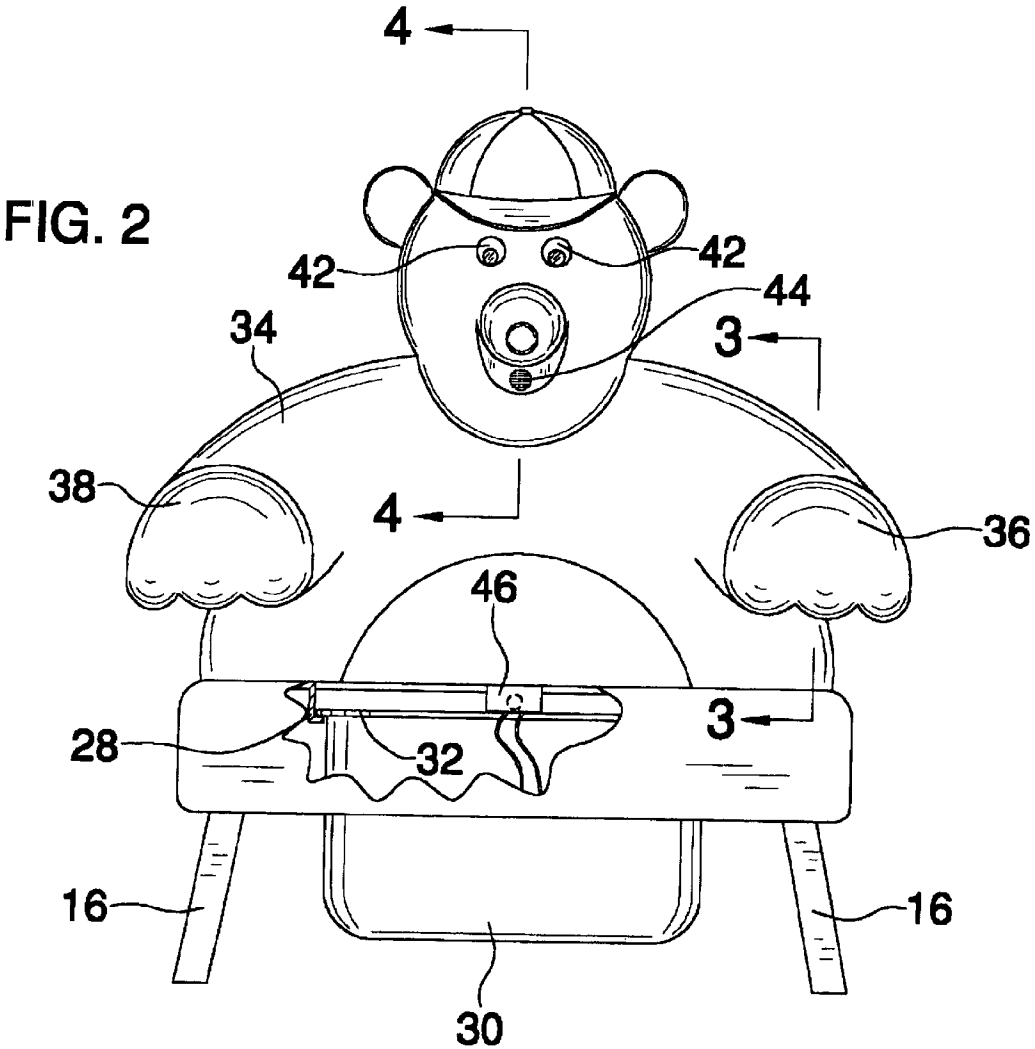
FIG. 2 is a schematic front view of the present invention.
Figure 3:
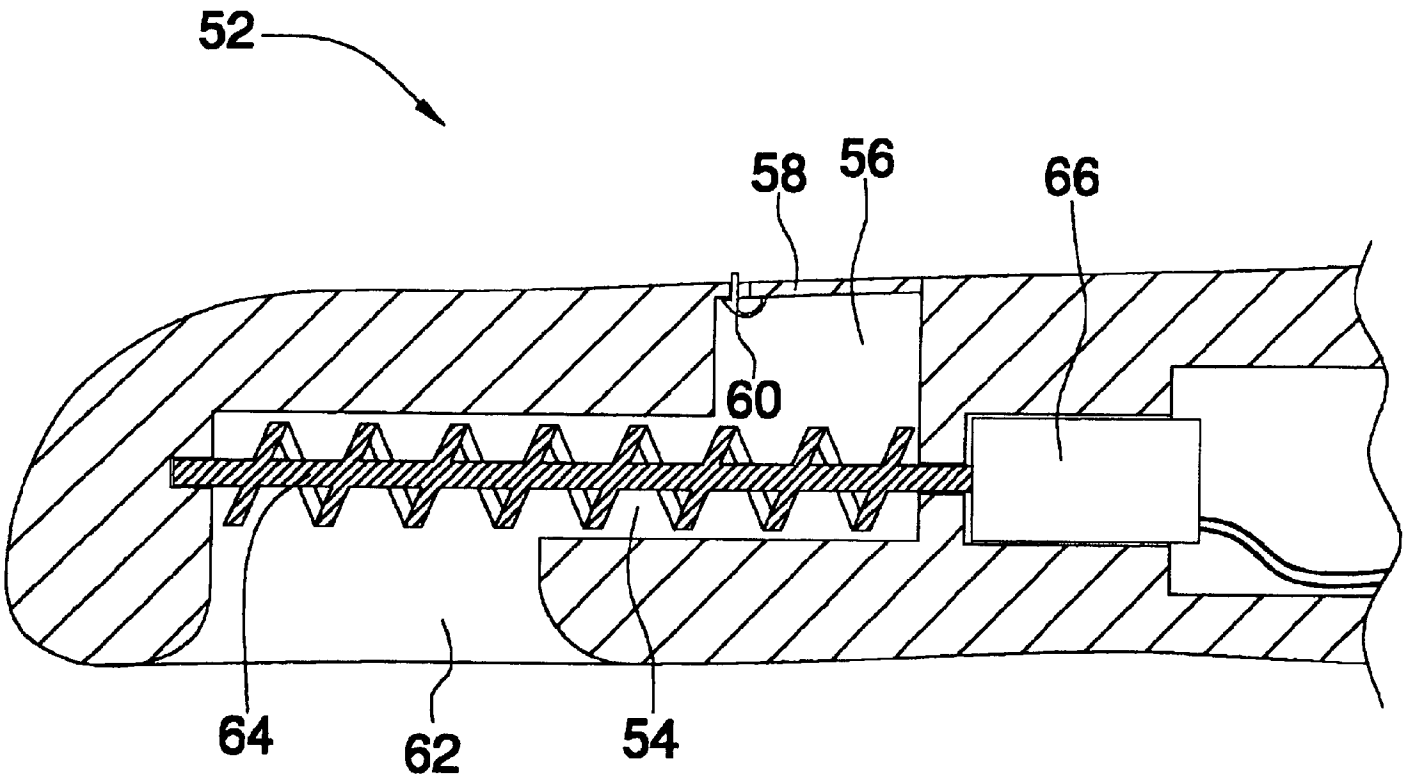
FIG. 3 is a schematic cross-sectional view taken along line 3—3 of FIG. 2 of the present invention.
Figure 4:
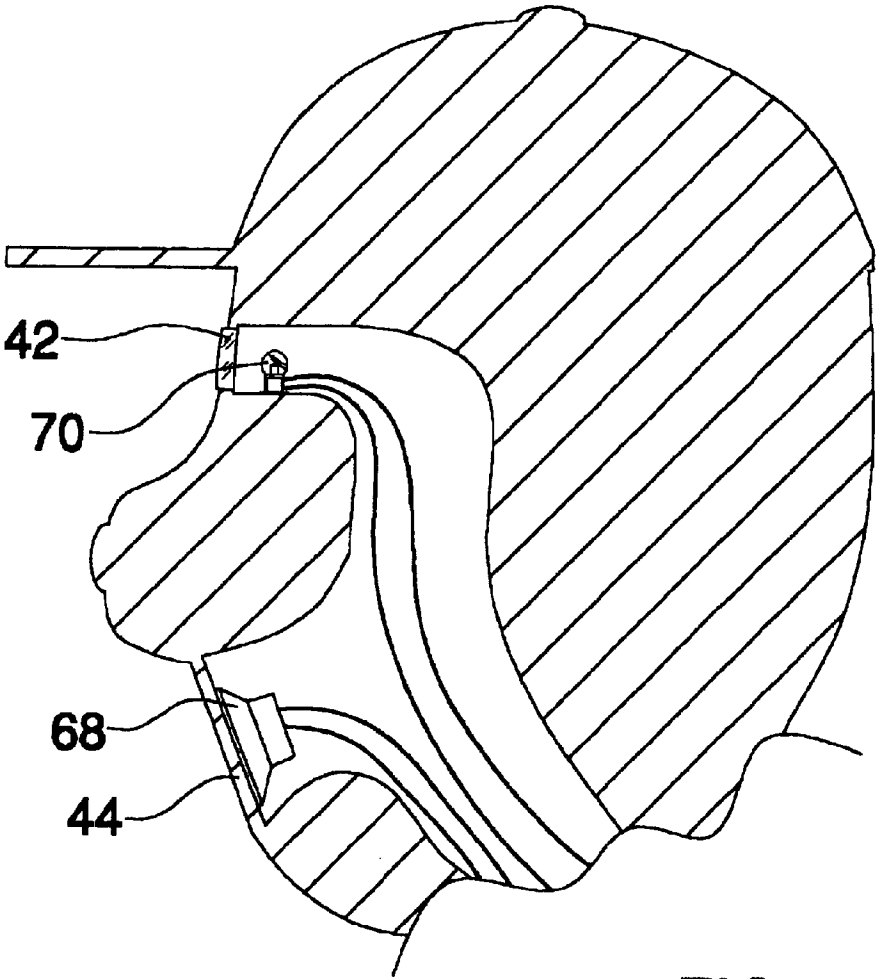
FIG. 4 is a schematic cross-sectional view taken along line 4—4 of FIG. 2 of the present invention.
Figure 5:
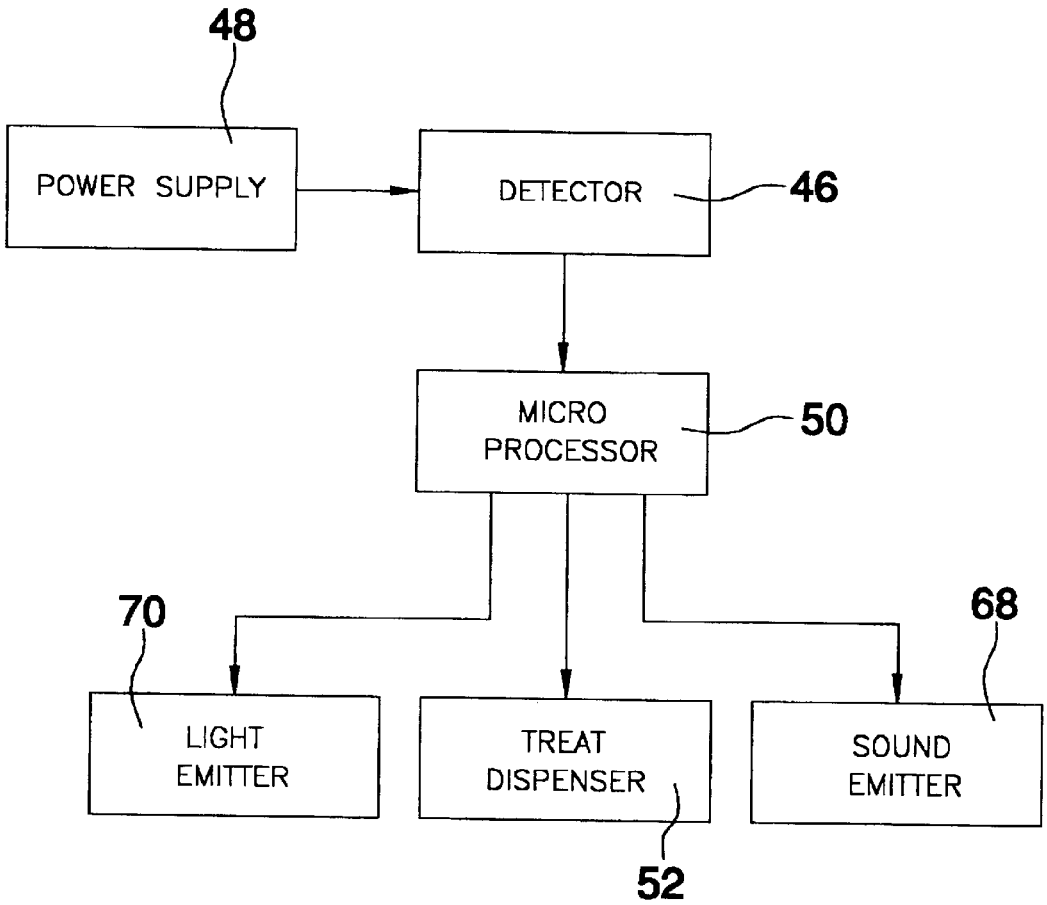
FIG. 5 is an electronic schematic view of the present invention.

As best illustrated in FIGS. 1 through 5, the toilet training assembly 10 generally comprises a stool 12 comprising a panel 14 and a plurality of legs 16 that are attached to and extend downwardly from the panel 14. The panel 14 has a front edge 18, a back edge 20, a first side edge 22 and a second side edge 24. The panel 14 has a centrally disposed aperture 26 therein. A peripheral flange 28 is attached to a peripheral edge of the aperture 26. The flange 28 is positioned below a top surface of the panel 14 and extends inward. A receptacle 30 is removably mountable in the aperture 26. The receptacle 30 has an upper edge having a peripheral lip 32 attached thereto. The peripheral lip 32 may be abutted against the peripheral flange 28 for supporting the receptacle 30 below the aperture 26 as shown in FIG. 2. The receptacle 30 may be removed for cleaning.

A back member 34 is attached to and extends upwardly from the back edge 20 of the stool 12. Each of a pair of arms 36, 38 is attached to and extends forward from the back member 34. The arms 36, 38 are spaced from each other and are spaced from the panel 14. A head 40 is attached to the back member 34. The head 40 includes a pair of eyes 42 and a mouth 44. The combination of the back member 34, pair of arms 36, 38 and head 40 resembles an animal, and more particularly, a teddy bear.

A motion detector 46 is mounted in the peripheral edge of the aperture 26 and is directed downwardly such that the motion detector 46 detects material, or excrement, entering the receptacle 30. The motion detector 46 may include a conventional infrared motion detector. Alternate detectors may also be utilized such as pressure sensitive detectors mounted on the peripheral flange 28 to determine when material has been added to the receptacle 30. A processor 50 is electrically coupled to the motion detector 46. The processor 50 is preferably mounted in the back member 34. A power supply 48 is electrically coupled to the processor 50. The power supply 48 may include a power plug but preferably includes one or more batteries removably mounted in the back member 34.

A dispenser assembly 52 for selectively dispensing candy, or other treats, is positioned in a first arm 36 of the pair of arms 36, 38. The assembly 52 is operationally coupled to the processor 50 so that the dispenser assembly 52 is turned on when the motion detector 46 detects motion. The dispenser assembly 52 includes a cavity 54 that is positioned in the first arm 36. A fill opening 56 extends into an upper side of the first arm 36. A door 58 is hingedly attached to the upper side for selectively opening or closing the fill opening 56. Preferably, the door 58 includes a latch 60 for selectively locking the door 58 such that a toddler would not be able to open the door 58. A dispensing opening 62 extends into a lower side of the first arm 36. The fill opening 56 and the dispensing opening 62 are vertically unaligned and preferably positioned at opposite ends of the cavity 54 as determined along a longitudinal axis of the firs arm 36. A push rod 64 extends through and is rotatably mounted in the cavity 54. The push rod 64 may include any coiled rod, corkscrew, or similar structure that may be used for moving material through the cavity 54 when the push rod 64 is rotated. The push rod 64 is preferably positioned along the longitudinal axis. A motor 66 is mounted in the first arm 36 and is mechanically coupled to the rod 64 for selectively rotating the rod 64 in a first direction. The motor 66 is electrically coupled to the microprocessor 50. Candy that is positioned in the fill opening 56 is moved toward and outward the dispensing opening 62 when the rod 64 is rotated in the first direction.

A sound emitter 68 is electrically coupled to the processor 50. The sound emitter 68 is mounted in the head 40 and emits congratulatory sounds when the motion detector 46 detects motion. The congratulatory sounds may include clapping, statements such as "good job" or any other sounds programmed into the processor. The sound emitter 68 is preferably a conventional speaker.

Each of a pair of light emitters 70 is electrically coupled to the processor 50. Each of the light emitters 70 is mounted in the head 40 and is positioned adjacent to one of the eyes 42. The eyes 42 are transparent for viewing the light emitters 70. The light emitters 70 emit light when the motion detector 46 detects motion.

In use, when a child uses the assembly 10, the detector 46 detects urine or fecal matter that enters the receptacle 30. The detector 46 sends a detection signal to the microprocessor 50. The microprocessor 50 causes the sound emitter 68 to play one of the congratulatory sounds, the light emitters 70 to light up, and the dispenser assembly 52 to dispense a predetermined amount of candy. The amount of candy may be determined by the amount of time the motor 66 is turned on. The candy that falls outwardly out of the first arm 36, as well as the light emitters 70 and the sound emitter 68, reward the child when the child uses the assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet training device for a toddler, said device comprising:

a stool comprising a panel and a plurality of legs being attached to and extending downwardly from said panel, said panel having a front edge, a back edge, a first side edge and a second side edge, said panel having a centrally disposed aperture therein, a receptacle being removably mountable in said aperture;

a back member being attached to and extending upwardly from said back edge of said stool, a pair of arms being attached to and extending forward from said back member, said arms being spaced from each other and spaced from said panel;

a motion detector being mounted in said peripheral edge of said aperture and being directed downwardly such that material entering said receptacle is detected by said motion detector;

a processor being electrically coupled to said motion detector; and a dispenser assembly for selectively dispensing candy being positioned in a first arm of said pair of arms, said assembly being operationally coupled to said processor wherein said dispenser assembly is turned on when said motion detector detects motion.

2. The toilet training device of claim 1, further including a peripheral flange being attached to a peripheral edge of said aperture, said flange being positioned below a top surface of said panel and extending inward, said receptacle having an upper edge having a peripheral lip attached thereto, wherein said peripheral lip may be abutted against said peripheral flange for supporting said receptacle below said aperture.

3. The toilet training device of claim 1, further including a head being attached to said back member, said head including a pair of eyes and a mouth, wherein said back member, pair of arms and head resembles an animal.

4. The toilet training device of claim 3, wherein said dispenser assembly includes:

a cavity being positioned in said first arm;

a fill opening extending into an upper side of said first arm, a door being hingedly attached to said upper side for selectively opening or closing said fill opening;

a dispensing opening extending into a lower side of said first arm, said fill opening and dispensing opening being vertically unaligned;

a push rod extending through and being rotatably mounted in said cavity; and a motor being mounted in said first arm and being mechanically coupled to said rod for selectively rotating said rod in a first direction, said motor being electrically coupled to said microprocessor, wherein candy being positioned in said fill opening is moved toward and outward said dispensing opening when said rod is rotated in said first direction.

5. The toilet training device of claim 1, wherein said dispenser assembly includes:

a cavity being positioned in said first arm;

a fill opening extending into an upper side of said first arm, a door being hingedly attached to said upper side for selectively opening or closing said fill opening;

a dispensing opening extending into a lower side of said first arm, said fill opening and dispensing opening being vertically unaligned;

a push rod extending through and being rotatably mounted in said cavity; and a motor being mounted in said first arm and being mechanically coupled to said rod for selectively rotating said rod in a first direction, said motor being electrically coupled to said microprocessor, wherein candy positioned in said fill opening is moved toward and outward said dispensing opening when said rod is rotated in said first direction.

6. The toilet training device of claim 3, further including a sound emitter being electrically coupled to said processor, said sound emitter being mounted in said head, said sound emitter emitting congratulatory sounds when said motion detector detects motion.

7. The toilet training device of claim 6, further including a pair of light emitters being electrically coupled to said processor, each of said light emitters being mounted in said head and being positioned adjacent to one of said eyes, said light emitters emitting light when said motion detector detects motion.

8. The toilet training device of claim 3, further including a pair of light emitters being electrically coupled to said processor, each of said light emitters being mounted in said head and being positioned adjacent to one of said eyes, said light emitters emitting light when said motion detector detects motion.

9. A toilet training device for a toddler, said device comprising:

a stool comprising a panel and a plurality of legs being attached to and extending downwardly from said panel, said panel having a front edge, a back edge, a first side edge and a second side edge, said panel having a centrally disposed aperture therein, a peripheral flange being attached to a peripheral edge of said aperture, said flange being positioned below a top surface of said panel and extending inward, a receptacle being removably mountable in said aperture, said receptacle having an upper edge having a peripheral lip attached thereto, wherein said peripheral lip may be abutted against said peripheral flange for supporting said receptacle below said aperture;

a back member being attached to and extending upwardly from said back edge of said stool, a pair of arms being attached to and extending forward from said back member, said arms being spaced from each other and spaced from said panel, a head being attached to said back member, said head including a pair of eyes and a mouth, wherein said back member, pair of arms and head resembles an animal;

a motion detector being mounted in said peripheral edge of said aperture and being directed downwardly such that material entering said receptacle is detected by said motion detector;

a processor being electrically coupled to said motion detector;

a dispenser assembly for selectively dispensing candy being positioned in a first arm of said pair of arms, said assembly being operationally coupled to said processor wherein said dispenser assembly is turned on when said motion detector detects motion, said dispenser assembly including; a cavity being positioned in said first arm;

a fill opening extending into an upper side of said first arm, a door being hingedly attached to said upper side for selectively opening or closing said fill opening;

a dispensing opening extending into a lower side of said first arm, said fill opening and dispensing opening being vertically unaligned;

a push rod extending through and being rotatably mounted in said cavity;

a motor being mounted in said first arm and being mechanically coupled to said rod for selectively rotating said rod in a first direction, said motor being electrically coupled to said microprocessor, wherein candy positioned in said fill opening is moved toward and outward said dispensing opening when said rod is rotated in said first direction;

a sound emitter being electrically coupled to said processor, said sound emitter being mounted in said head, said sound emitter emitting congratulatory sounds when said motion detector detects motion;

a pair of light emitters being electrically coupled to said processor, each of said light emitters being mounted in said head and being positioned adjacent to one of said eyes, said light emitters emitting light when said motion detector detects motion; and a power supply being electrically coupled to said processor.

* * * * *